United States Patent [19]

Gagnebin

[11] Patent Number: 4,493,562

[45] Date of Patent: Jan. 15, 1985

[54] WATER TIGHT WATCH-CASE

[75] Inventor: Gaston Gagnebin, Bienne, Switzerland

[73] Assignee: Omega SA, Bienne, Switzerland

[21] Appl. No.: 482,376

[22] Filed: Apr. 5, 1983

[30] Foreign Application Priority Data

Apr. 13, 1982 [FR] France ..... 82 06703

[51] Int. Cl.[3] ..... G04B 37/00

[52] U.S. Cl. ..... 368/294

[58] Field of Search ..... 368/88, 226, 221, 223, 368/276, 280, 286, 287, 291, 294–300

[56] References Cited

U.S. PATENT DOCUMENTS

| | | | |
|---|---|---|---|
| 1,718,228 | 6/1929 | Gleason | 368/294 |
| 3,729,924 | 5/1973 | Aoki | 58/90 |
| 4,322,834 | 3/1982 | Schaeren et al. | 368/296 |
| 4,390,288 | 6/1983 | Arnoux | 368/294 |
| 4,417,821 | 11/1983 | Herchenrach | 368/294 |
| 4,420,264 | 12/1983 | Murata | 368/294 |

FOREIGN PATENT DOCUMENTS

| | | | |
|---|---|---|---|
| 822817 | 11/1951 | Fed. Rep. of Germany | 368/294 |
| 2251044 | 8/1978 | France | 368/294 |
| 206230 | 7/1939 | Switzerland . | |
| 207376 | 2/1940 | Switzerland | 368/296 |
| 616810 | 10/1980 | Switzerland . | |

*Primary Examiner*—Vit W. Miska

*Attorney, Agent, or Firm*—Griffin, Branigan & Butler

[57] ABSTRACT

A watch-case comprises, superposed onto the case-band (1), a sealing gasket (4), a ring forming a flange (2) and a watch-glass (3).

The thus-formed assembly is fixed to the case-band by means of claws (10) which grip the watch-glass and which are arranged on the periphery of the case-band. The claws are provided with an internally threaded portion (11) which fits into an opening (7) provided on the periphery of the watch-glass and which receives a screw (12) the head of which is supported by a cut-out provided on the underside of the case-band.

7 Claims, 5 Drawing Figures

WATER TIGHT WATCH-CASE

This invention concerns a water tight watch-case comprising a case-band, a flange superposed onto the case-band and a watch-glass supported by the flange.

BACKGROUND OF THE INVENTION

Various designs of water tight watch-cases have already been proposed which might be defined by the basic definition which has been given above. If reference should be made for instance to U.S. Pat. No. 3,729,924 one will find there a watch-glass fixed by means of an adhesive onto a ring forming a flange. Between the ring and the case-band is arranged a sealing gasket. The ring is provided with a notch arranged to grasp a bezel which is fixed to the case-band by means of screws of which the heads are supported on openings arranged in the underside of the case-band. When the screws are tightened down, the sealing gasket is compressed, thereby sealing the watch-case against moisture.

If this design may be said to give satisfactory solution to the sealing problem for a watch-case, it is no longer applicable to modern designs where it is desired to have an edge to edge mounting of the watch-glass onto the case-band. In effect, the bezel which is normally provided has a certain width and projects over the edge of the watch-glass, thus preventing the desired aesthetic aspect.

As much may be said concerning French patent 2 251 044 cited in the search report. The water tight watch described therein is provided with a bezel which is fixed on the upper face of the case-band by fixing feet. The bezel which forms a frame is provided with claws distributed on the sides opposed to the frame in a manner to be supported on at least two bevelled surfaces of the watch-glass and to press this latter against a sealing gasket. However, this arrangement likewise does not permit an edge to edge setting of the watch-glass onto the case-band.

The purpose of the present invention is to provide a water tight watch-case in which the watch-glass is fixed to the case by claws in the same manner as a gem is set into its mounting and this according to means which will be defined in the claims.

In each of the figures shown here, the chosen reference numbers designate the same components throughout.

DETAILED DESCRIPTION OF THE INVENTION

Figure 1:
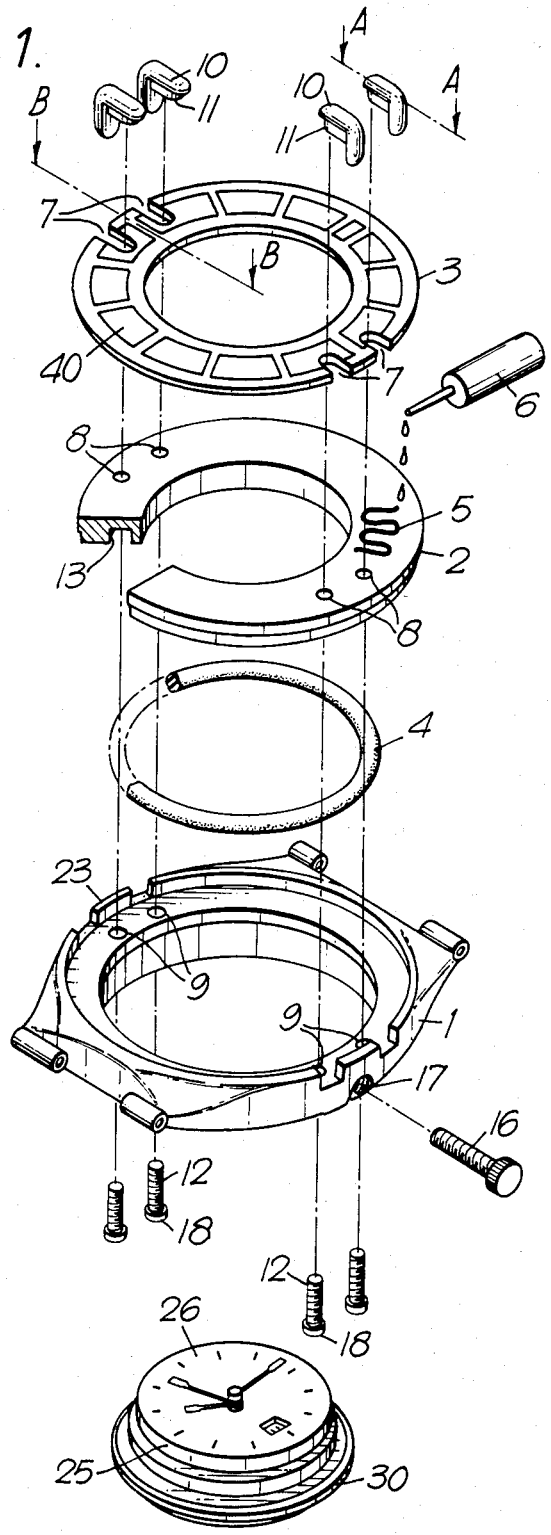
FIG. 1 is an exploded perspective view of a watch-case according to a first variant of the invention.

FIG. 1 shows a first variant of the watch-case according to the invention. Onto case-band 1 are mounted in superposition a ring 2 forming a flange and a watch-glass 3. Between the case-band and the ring a sealing gasket 4 is maintained in place by a groove 13 arranged under ring 2. The watch-glass is cemented onto the ring and the operation is here illustrated by the traces of glue 5 and tube 6. In the periphery of the watch-glass are arranged openings 7 which are disposed facing bores 8 and 9 pierced respectively in the ring and the case-band. When the assembly formed by the watch-glass and the ring is posed on the case-band, the claws 10 are put into place. As may be seen from the diagram, these claws, on one hand, jut out over the watch-glass and, on the other hand, are arranged to project from the periphery of the case-band. Each of the claws 10 is provided with a threaded portion 11 placed under the element which juts over the watch-glass. This threaded portion is set within opening 7 and, in the variant shown here, is supported on the upper surface of ring 2. In order that this may be so, it is naturally necessary that the height of the threaded portion 11 be greater than the thickness of the watch-glass. If such height should exceed only by some hundredths of a millimeter the thickness of the watch-glass, it will appear that it is the claw 10 which holds the watch-glass in place. In the threaded portion 11 is fitted screw 12 which traverses bores 8 and 9 in order to fix the assembly of watch-glass 3, ring 2 and gasket 4 on the case-band 1 wherein the threaded portion 11 is supported on ring 2.

The invention is not limited to an elongated and non closed form of openings 7. These openings may be present in the form of a hole on the condition that the form of the threaded portion is suitably adapted. Such an arrangement of the opening is to be found in FIG. 5 which will be subsequently discussed.

The movement is introduced from the underside of the case-band. The watch-case is closed by back cover 30. FIG. 1 also shows the time-setting stem 16 which is introduced into the side opening 17.

Figure 2:
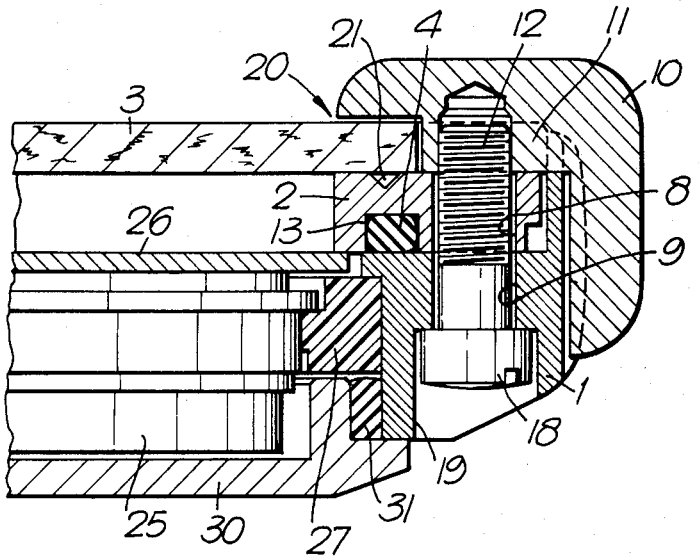
FIG. 2 is a cross-section according to line A—A on FIG. 1.

FIG. 2 is a cross-section in accordance with line A—A on FIG. 1. It shows how the various components of the case appear when assembled. Thus are to be found in superposition case-band 1, the ring forming flange 2, the watch-glass 3 and the claw 10. This assembly is held in place by screw 12 of which the head 18 is supported in a counter bore 19 arranged in the underside of the case-band. Screw 12 traverses bores 9 and 8 pierced respectively in the case-band 1 and ring 2 and is screwed into the threaded portion 11 which forms an integral part of claw 10. The figure shows that the height of the threaded portion is greater than the thickness of watch-glass 3 to an extent such that a small space 20 is arranged between the claw and the watch-glass. The threaded portion 11 is supported directly on ring 2 when screw 12 is tightened, thus directly fixing the watch-glass to the case since said watch-glass is cemented onto the ring which latter is tightened against the case-band. The sealing is assured, on one hand, by the gasket 4 placed in groove 13 arranged on the lower face of the ring and, on the other hand, by the cement interposed between the watch-glass and the upper face of the ring.

It is generally difficult to place glue or cement in an even layer around the entire circumference of the ring. Thus it will be noted that often it has a tendency to separate into pools when the watch-glass is pressed against the ring. To overcome this difficulty the invention foresees the use of a groove 21 on the upper face of the ring 2. This groove not only receives the surplus glue and thus avoids overflows onto the interior portion of the ring, but additionally permits the assurance of a continuous belt of sealing around the entire circumference formed by the groove.

From the arrangement which has just been described it will be understood that all measures have been taken to assure a perfect sealing of the watch-case, at least as far as its upper portion is concerned. Claws 10 confer onto the assembly not only a novel aesthetic aspect, but play an additional functional role of fixing together the various elements composing the upper portion of the case.

Although not exclusively reserved to watch-cases of this type, the arrangement as described will above all find an application in watch-cases where the periphery of the watch-glass coincides with the periphery of the case-band or is very slightly inset thereform since in such case the bezel no longer exists and one may not benefit therefrom as has been described in U.S. Pat. No. 3,729,924 already cited.

Figure 3:
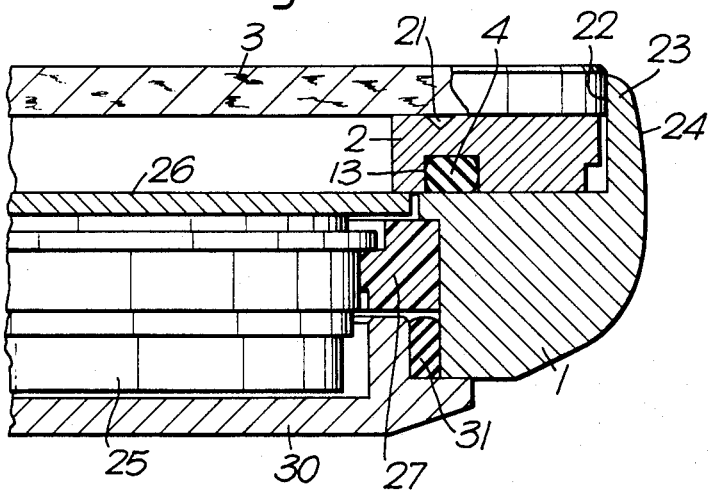
FIG. 3 is a cross-section according to line B—B on FIG. 1.
Figure 4:
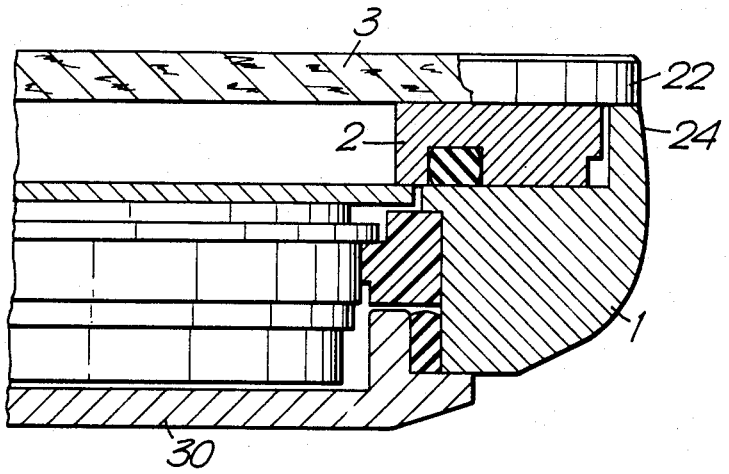
FIG. 4 is a variant in construction derived from FIG. 3.

For an illustration of this, FIG. 3 which is a cross-section according to line B—B of FIG. 1 shows that the periphery 22 of watch-glass 3 is very slightly inset from periphery 24 of the case-band 1 whereby there remains a rim 23 which surrounds the watch-glass. FIG. 4 is a variant derived from FIG. 3 where it will be noted that the periphery 22 of watch-glass 3 is mounted flush with the periphery 24 of case-band 1.

FIGS. 3 and 4 show in outline how the movement is fitted into the watch-case. Movement 25 is introduced from below and dial 26 is arranged to butt against the lower face of ring 2 forming the flange. Following, there is introduced the enlarging ring 27 and the entire assembly is maintained in place by clamps supported in cut-outs and screwed to the movement. The case is closed by a bottom cover 30 and sealed by means of packing 31. This arrangement permits an easy access to the movement and the battery without the necessity of taking apart the upper portion of the watch-case.

The first variant of the invention which has just been described is particularly suitable for cases provided with sapphire watch-glasses. Effectively, if claws 10 are supported directly on such a watch-glass, there would be initially a risk of breaking the glass at the moment when the screws 12 are tightened. More important, such glass will not resist shocks applied thereto owing to non-uniform stresses provoked by the point-to-point fixing brought about by the claws. The arrangement whereby the glass is glued by its entire periphery to the ring and it is the ring which is fixed to the case-band by the claws, distributes the stresses uniformly and renders the watch-glass much more resistant to shocks. Tests which have been carried out have shown that for a watch-glass of 0.8 mm thickness it is possible to apply a shock of 5000 g without causing breaking if the glass is fixed to the watch-case according to the construction recommended by the invention. Such a result permits the diminution to 0.6 mm or even less, of glass thickness, and thereby enables still further limiting the thickness of the watch.

Figure 5:
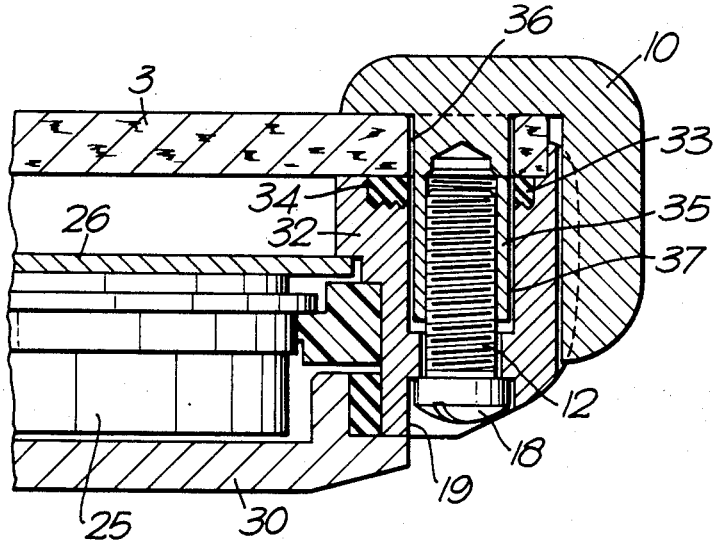
FIG. 5 is a cross-section of a second variant of the invention.

FIG. 5 shows a second variant of the watch-case according to the invention. This construction is distinguished from the former by the fact that claw 10 is directly supported on watch-glass 3. Such construction will be preferably employed in respect of a watch-case equipped with a watch-glass in mineral glass, more elastic and thus less sensible to the effects of shock.

In this arrangement, flange 32 is integrally formed with the case-band 1 and watch-glass 3 is supported on the flange without cementing. A sealing gasket 33 is interposed between the watch-glass and the flange in a groove 34. Claw 10 is provided with a threaded portion 35 in the form of a cylinder engaged not only in opening 36 arranged in the watch-glass as was the case in the preceding variant, but further projecting into an opening 37 arranged in the flange and the case-band. A space sufficiently large is provided between the lower extremity of the threaded portion 35 and the bottom of opening 37 in order to permit the claw to be supported directly on the watch-glass when the screw 12 is tightened, the head of which is supported in counter bore 19 arranged in the underside of the case-band.

Finally, certain observations may be made concerning both variants which have been described hereinabove.

To assure a satisfactory fixing of the glass it will be understood that at least two claws 10 are necessary which will be diametrically disposed with respect to one another. In the example shown in FIG. 1, there has been chosen an arrangement in the form of claws arranged in pairs which may recall and continue the motifs used for the realization of the bracelet (not shown). One might also employ claws distributed uniformly from one another around the periphery.

FIGS. 1, 2 and 5 show that the claw is arranged projecting from the periphery of the case-band. It is however evident that an arrangement may also be conceived wherein such claw penetrates into the side of the case-band in order to be flush therewith.

To hide the flange, the watch-glass may have a metallization on its lower surface. FIG. 1 shows such metallization in the form of sectors 40 and lines 41 which at the same time provide the hour hand references. It is obvious that any other form of decoration may be employed.

What we claim is:

1. A water tight watch case comprising:

a case band;

an annularly-shaped flange superposed onto the case band and a watch glass supported by the flange and extending across an opening of the annularly-shaped flange;

at least two claws each having a generally L-shape with a first leg of the L being positioned over and adjacent an upper surface of the watch glass and the second leg extending downwardly along the case band, the first leg of each claw being provided with a threaded portion adapted to fit into an opening provided in the watch glass; and, for each claw a screw passing through an opening in said watch band to mesh with said threaded portion of said first leg inside the general outer periphery of said watch glass;

thereby to assure the fixing of the watch glass to the watch case.

2. A water tight watch case as recited in claim 1 wherein said watch glass defines an outer periphery which is generally similar in shape and size to the outer periphery of the case band.

3. A watch-case as set forth in claim 1 wherein the watch-glass is cemented onto a ring forming the flange and the thus-formed assembly is fixed to the case-band by the bearing of the threaded portion of the claws onto the ring, the height of said threaded portion being greater than the thickness of the watch-glass in order to prevent the claws from bearing directly onto the watch-glass.

4. A watch-case as set forth in claim 3 wherein the portion of the ring in contact with the watch-glass is provided with a groove arranged to received excess cementing material.

5. A watch-case as set forth in claim 3 wherein a sealing gasket is arranged between the ring and the case-band.

6. A watch-case as set forth in claim 1 wherein the flange is integrally formed with the case-band, the threaded portion being further adapted to fit into an opening provided in the flange whereby the watch-glass is fixed onto the flange by direct bearing of the claws onto the watch-glass.

7. A watch-case as set forth in claim 6 wherein a sealing gasket is arranged between the flange and the watch-glass.

* * * * *